United States Patent [19]

Hand

[11] 4,336,013

[45] Jun. 22, 1982

[54] APPARATUS FOR FORMING CONCRETE ARTICLES OF UNIFORM DENSITY

[75] Inventor: George E. Hand, Williamstown, N.J.

[73] Assignee: Kerr Concrete Pipe Company, Folsom, N.J.

[21] Appl. No.: 39,316

[22] Filed: May 16, 1979

[51] Int. Cl.[3] ..... B28B 3/18; B28B 21/24

[52] U.S. Cl. ..... 425/145; 425/429; 425/150; 425/262; 425/427; 425/449; 425/457

[58] Field of Search ..... 264/40.1, 40.4, 40.7, 264/309, 310, 312; 425/262, 140, 146, 145, 60, 145, 148, 218, 272, 418, 426, 427, 365, 449, 150, 457; 318/39, 71, 80

[56] References Cited

U.S. PATENT DOCUMENTS

| | | | |
|---|---|---|---|
| Re. 28,902 | 7/1976 | Trautner | 425/262 |
| 1,473,969 | 11/1923 | Nichols | 425/418 |
| 1,904,094 | 4/1933 | Snyder | 264/309 |
| 1,938,230 | 12/1933 | Ukropina | 425/262 |
| 2,443,656 | 6/1948 | King | 318/39 |
| 2,544,453 | 3/1951 | Gaudin | 425/418 |
| 2,593,665 | 4/1952 | Glassen | 425/262 |
| 2,641,818 | 6/1953 | Eschenbrenner | 425/262 |
| 2,704,873 | 3/1955 | Kirwan et al. | 425/262 |
| 2,758,352 | 8/1956 | Perkins | 425/262 |
| 2,766,939 | 10/1966 | Weston | 318/39 |
| 3,329,806 | 7/1967 | McCauley | 318/39 |
| 3,459,378 | 8/1969 | Hill | 318/39 |
| 3,626,262 | 12/1971 | Kelling | 318/39 |
| 3,632,270 | 7/1965 | Baker | 425/262 |
| 3,649,727 | 3/1972 | Gauger | 425/262 |
| 3,660,003 | 5/1972 | Waddington | 425/427 |
| 3,662,437 | 5/1972 | Long | 425/262 |
| 3,746,494 | 7/1973 | Gauger | 425/262 |

OTHER PUBLICATIONS

Gove et al., Webster's Third New International Dictionary, Merriam, Springfield, (1963), pp. 920 & 921.

*Primary Examiner*—Willard E. Hoag
*Attorney, Agent, or Firm*—Ronald G. Goebel

[57] ABSTRACT

An apparatus for forming concrete articles of uniform density, which includes means for forming concrete into the form of the articles, and means for sensing the density of concrete in each area of formation in the forming means as the article is being formed, comparing the sensed density to a preset density, and compensating for variation of the sensed density from the preset density responsive to such comparison, such that the density of concrete in each area of formation in the forming means as the article is being formed equals the preset density.

3 Claims, 3 Drawing Figures

APPARATUS FOR FORMING CONCRETE ARTICLES OF UNIFORM DENSITY

BACKGROUND OF THE INVENTION

The invention relates generally to concrete articleforming devices, and relates specifically to an apparatus for forming concrete articles of uniform density.

Presently, devices for forming concrete into articles, such as lengths of concrete pipe, include a revolving packing head for packing concrete against the inner wall of a mold, a conveyor for feeding concrete into the area between the packing head and the mold inner wall as the article is being formed, and means for moving the packing head through the mold so as to form the article.

The density of concrete in each area of formation, as an article is being formed, is generally non-uniform in such devices. Such non-uniform density is a result of inefficient operator control of such devices. In operating such devices, the operator visually assesses the uniformity of density of concrete, and manually adjusts the rate of feeding concrete from the conveyor into the area of formation between the packing head and the mold as the article is being formed. Such operator-controlled procedures are highly inefficient and ineffective.

Non-uniform density of concrete in areas of formation as the article is being formed in such devices, resulting from inefficiency in such operator-controlled procedures, generates formation of stresses in the article, as the revolving motion of the packing head compacts such concrete of non-uniform density. In forming non-reinforced concrete articles in such devices, such stresses generate cracks which substantially weaken such articles, resulting in damage thereto, and leakage therefrom during use thereof. In forming reinforced concrete articles in such devices, such stresses generate bending and deflection of the reinforcing wire, which forms voids therein and substantially weaken such articles, resulting in damage thereto, and leakage therefrom during use thereof.

SUMMARY OF THE INVENTION

In view of the above problems in present devices, as well as others, it is among the objects of the invention to provide an apparatus for forming concrete articles of uniform density, automatically, in a convenient and efficient manner.

The above objects, as well as others, are provided for in the invention by means of an apparatus for forming concrete articles of uniform density, which includes means for forming concrete into the form of the articles, and means for sensing the density of concrete in each area of formation in the forming means as the article is being formed, comparing the sensed density to a preset density, and compensating for variation of the sensed density from the preset density responsive to such comparison, such that the density of concrete in each area of formation in the forming means as the article is being formed equals the preset density.

DESCRIPTION OF THE DRAWINGS

The invention is illustrated, by way of example thereof, in the accompanying drawings, in which.

DESCRIPTION OF THE PREFERRED EMBODIMENT

Figure 1:
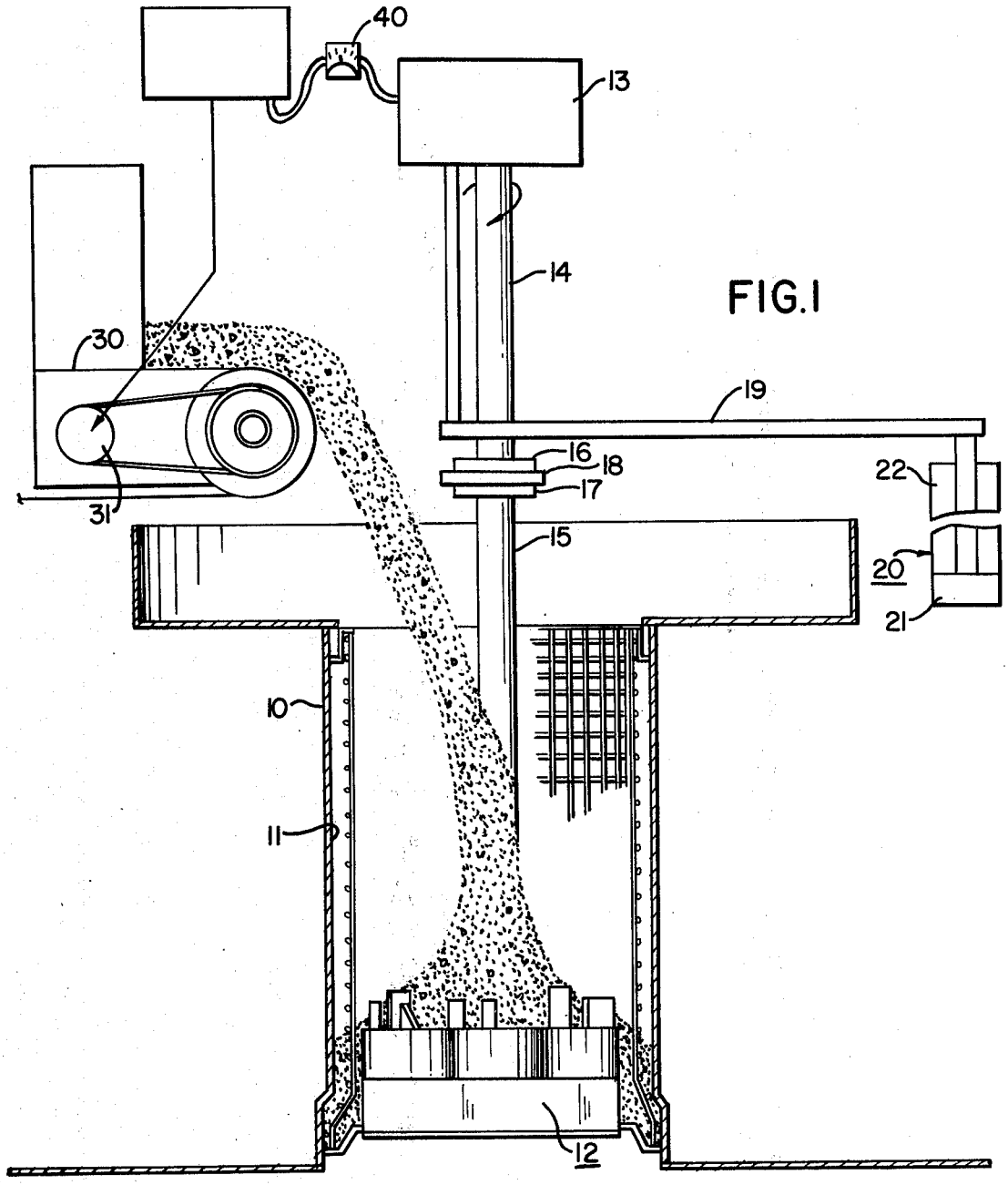
FIG. 1 is an elevational, partly-sectional, partly-fragmentary view of a concrete article-forming apparatus, pursuant to the invention.
Figure 2:
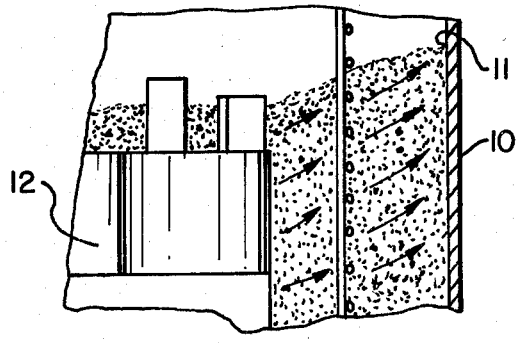
FIG. 2 is an elevational, sectional, fragmentary view of an area of formation in the forming means as the article is being formed in such apparatus.
Figure 3:
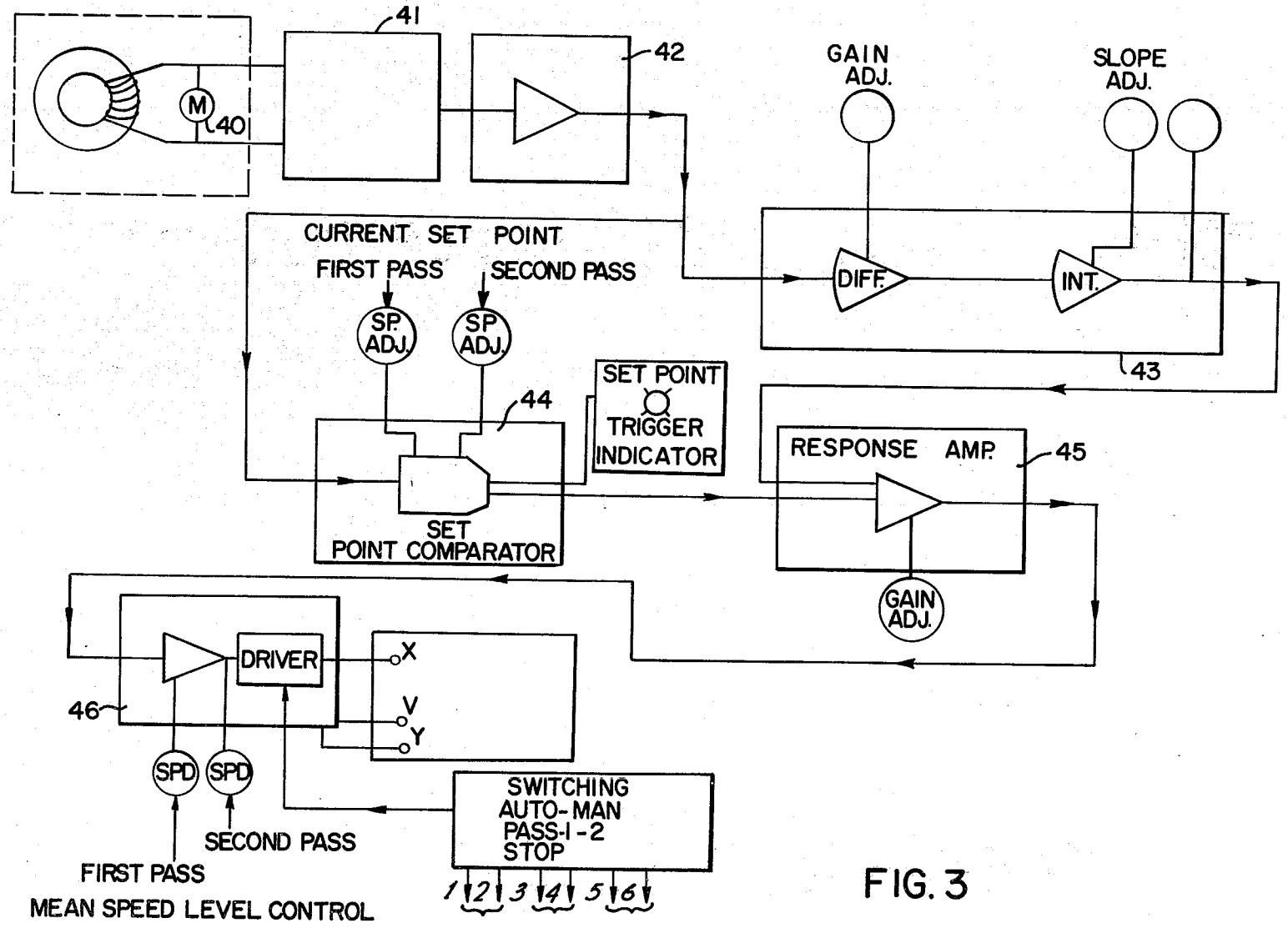
FIG. 3 is a schematic circuit diagram of the sensing, comparing, and compensating means in such apparatus.

The preferred embodiment of the invention, as illustrated in FIGS. 1–3, comprises, for example, an apparatus for forming concrete articles of uniform density, including means for forming concrete into the form of the articles, and means for sensing the density of concrete in each area of formation in the forming means as the article is being formed, comparing the sensed density to a preset density, and compensating for variation of the sensed density from the preset density responsive to such comparison, such that the density of concrete in each area of formation in the forming means as the article is being formed equals the preset density.

The forming means comprise a mold 10, which includes an inner wall 11, a packing head 12, for packing concrete against mold inner wall 11, means for revolving packing head 12, and means for moving packing head 12 through mold 10. The revolving means comprise means for driving packing head 12, and means for connecting the driving means to packing head 12. The driving means comprise a motor 13. The connecting means comprise a shaft 14, which extends from motor 13, a shaft 15, which extends from packing head 12, a pulley 16, mounted on shaft 14, a pulley 17, mounted on shaft 15, and a belt 18, extending about and interconnecting pulley 16 and pulley 17. The moving means comprise support 19, to which packing head 12 and the revolving means are connected, and means for moving support 19. Motor 13 is mounted on support 19, shaft 14 extends through support 19, and shaft 15 is journalled in support 19. The moving means comprise a cylinder 20, which includes a piston 21, and a rod 22, connected to support 19.

The apparatus further includes means for feeding concrete into the forming means. The feeding means comprise a conveyor 30, onto which concrete may be fed from a source thereof, and from which concrete may be fed into the forming means, and means for driving conveyor 30. The driving means comprise a motor 31.

The sensing, comparing, the compensating means include means for sensing the torque generated in motor 13, in revolving packing head 12, for packing concrete against mold inner wall 11, in each area of formation in the forming means as the article is being formed, comprising means for measuring current in motor 13. The measuring means comprise an ammeter 40, connected to motor 13, to which the comparing means is connected. The sensing, comparing and compensating means further include means for comparing the sensed torque to a preset torque, comprising means for comparing the sensed current measurement to a preset measurement. The comparing means comprise a rectifier 41, connected to ammeter 40, an amplifier 42, connected to rectifier 41, an analog computer 43, connected to amplifier 42, and a set point comparator 44, connected to analog computer 43. The sensing, comparing and compensating means further include means for compensating for variation of the sensed density from the preset density responsive to such comparison, such that the density of concrete in each area of formation in the forming means as the article is being formed equals the preset density. The compensating means comprise a response amplifier 45, to which analog computer 43 and set point comparator 44 are connected, and a mean speed level controller 46, connected to response amplifier 45 and to motor 31.

In operation, a measurement for current in motor 13 for driving packing head 12 for forming the article is preset in set point comparator 44, and motor 13 and motor 31 are turned on.

Motor 13 drives packing head 12 through shaft 14, pulley 15, belt 18, pulley 17, and shaft 15. Motor 31 drives conveyor 30, which feeds concrete from a source thereof into the area between packing head 12 and mold inner wall 11. Packing head 12 is elevated and lowered through mold 10 by cylinder 20, through piston 21, rod 22, support 19, motor 13, shaft 14, pulley 15, belt 18, pulley 16, and shaft 15.

The ammeter 40 measures current in motor 13. Current in motor 13, measured by such ammeter 40, is dependent upon torque generated in packing head 12, which in turn is dependent upon density of concrete in each area of formation in the forming means as the article is being formed. Such current measurement is rectified in rectifier 41, amplified in amplifier 42, and processed through analog computer 43, and set point comparator 44, where it is compared to the preset current measurement, and then processed through response amplifier 45, and through mean speed level controller 46, so as to control motor 31, to compensate for variation of sensed current measurement from preset current measurement in motor 13 by controlling the rate of feeding concrete from conveyor 30 into each area of formation between packing head 12 and mold inner wall 11 as the article is being formed, responsive to such comparison, such that the density of concrete in each area of formation in the forming means equals the preset density.

The sensing, comparing, and compensating means respond automatically and instantaneously to variations in current measurements in motor 13 from the preset current measurement, to automatically and instantaneously control motor 31 and adjust the rate of feeding concrete from conveyor 30 into the area between packing head 12 and mold inner wall 11 responsive thereto, to make the density in each area of formation in the forming means uniform as the article is being formed.

The preferred embodiment of the invention has been set forth above. It is to be understood, however, that variations may be made in such preferred embodiment, which variations may nevertheless be within the scope and spirit of the invention. The invention is therefore to be broadly construed, within the scope and spirit of the claims herein.

I claim:

1. An apparatus for forming concrete pipe of uniform density comprising:

(a) means for forming concrete into the form of said pipe comprising a mold having an inner wall, a packing head for packing concrete against said inner wall, a shaft centrally mounted on said packing head, an electric packing head motor for revolving said packing head through the mold; and means for raising said packing head only at a fixed rate;

(b) means for feeding concrete to said forming means;

(c) a feed motor for driving said concrete feeding means;

(d) means for sensing and measuring current in said packing head motor, said current being a function of torque generated in said packing head;

(e) means for comparing said sensed current to a preset current; and (f) means for controlling the speed of said feed motor responsive to said sensing and comparing means.

2. The apparatus of claim 1, wherein the feeding means comprises a conveyor, into which concrete may be fed from a source thereof, and from which concrete may be fed into the forming means.

3. An apparatus as in claim 1, in which the measuring means comprise an ammeter, connected to the motor, and to which the comparing means are connected.

* * * * *